United States Patent [19]

Miranda

[11] Patent Number: 4,813,686

[45] Date of Patent: Mar. 21, 1989

[54] SHUTTLECOCK

[76] Inventor: Gonzalo F. Miranda, P. O. Box 12139, Arlington, Va. 22209

[21] Appl. No.: 145,311

[22] Filed: Jan. 19, 1988

[51] Int. Cl.[4] ..... A63B 67/18

[52] U.S. Cl. ..... 273/417

[58] Field of Search ..... 273/417; D21/207

[56] References Cited

U.S. PATENT DOCUMENTS

| | | | |
|---|---|---|---|
| D. 287,989 | 1/1987 | Kornhaber | D21/207 |
| 2,012,730 | 8/1935 | Reid | 273/417 |
| 2,911,219 | 11/1959 | Arokiasamy | 273/417 |
| 3,507,494 | 4/1970 | Finkel | 273/417 X |
| 3,784,202 | 1/1974 | Pon | 273/417 |
| 3,901,509 | 8/1975 | Liong | 273/417 |
| 4,657,262 | 4/1987 | Buckland | 273/417 |

FOREIGN PATENT DOCUMENTS

| | | | |
|---|---|---|---|
| 1035547 | 7/1958 | Fed. Rep. of Germany | 273/417 |
| 1005634 | 12/1951 | France | 273/417 |
| 1578301 | 7/1969 | France | 273/417 |
| 824778 | 12/1959 | United Kingdom | 273/417 |
| 1402985 | 8/1975 | United Kingdom | 273/417 |
| 2157580A | 10/1985 | United Kingdom | 273/417 |

*Primary Examiner*—Paul E. Shapiro

*Attorney, Agent, or Firm*—Robbins & Laramie

[57] ABSTRACT

A shuttlecock for a recreational game comprising a weighted base, a soft resilient cushion that helps prevent injury to players, and a tail flexibly connected to the base.

10 Claims, 4 Drawing Sheets

SHUTTLECOCK

BACKGROUND OF THE INVENTION

The invention is directed toward a new shuttlecock. In particular the invention is directed toward a shuttlecock used in a game in which the device is struck by hand and vollied between two or more players.

Shuttlecocks or birdies have been used in the game of badminton. A light strung raquet is used to strike the shuttlecock back and forth over a net between two players or teams. There are games similar to badminton where a shuttlecock is struck with the hand, between two or more players with or without a net.

There are currently some disadvantages related to the shuttlecock. One disadvantage is that most shuttlecocks are manufactured with a weighted base. After extended play, the player's hands can be bruised or hurt by a repeated striking of the shuttlecock. Some devices have a cushioned basse filled with fiber or granular stuffing for protecting the hand of the player. However, such devices are fragile and may tear, with the consequence that the stuffing pours out of the base cushion. The device is thus no longer useful and the loose stuffing crates litter.

Another problem with some shuttlecocks is the tendency to stray from the intended trajectory. This is due, in part, to improper weight distribution. When some of the stuffing is lost from the base, the shuttlecock will be further unbalanced. For example, its center of gravity may not be along the central axis of the shuttlecock. Also, the tail design of the shuttlecock may adversely alter the intended trajectory of the shuttlecock.

SUMMARY OF THE INVENTION

The present invention is a shuttlecock comprising a disc shaped, multi-layered, weighted base having front and rear sides and a plurality of circumferentially spaced elongated axial openings positioned adjacent to an outer margin of the base. A hemispherically shaped cushion attached to the base is formed of a flexible material and includes a sheet like circular member and a plurality of radial straps corresponding in number to the number of openings in the base. The radial straps extend from an outer margin of the circular member and each strap has a free end, one each of said straps being fed into and extending through a corresponding one of the openings in the base so that the cushion is drawn adjacent the front side of the base. The circular member covers the cushion such that when the straps are drawn through the openings, the circular member forms a curved surface over the front side of the base. Portions of the curved surface between adjacent straps are arcuatly spaced away from the front surface. A tail portion is flexibly attached to the straps of the base.

DETAILED DESCRIPTION OF THE INVENTION

Figure 1:
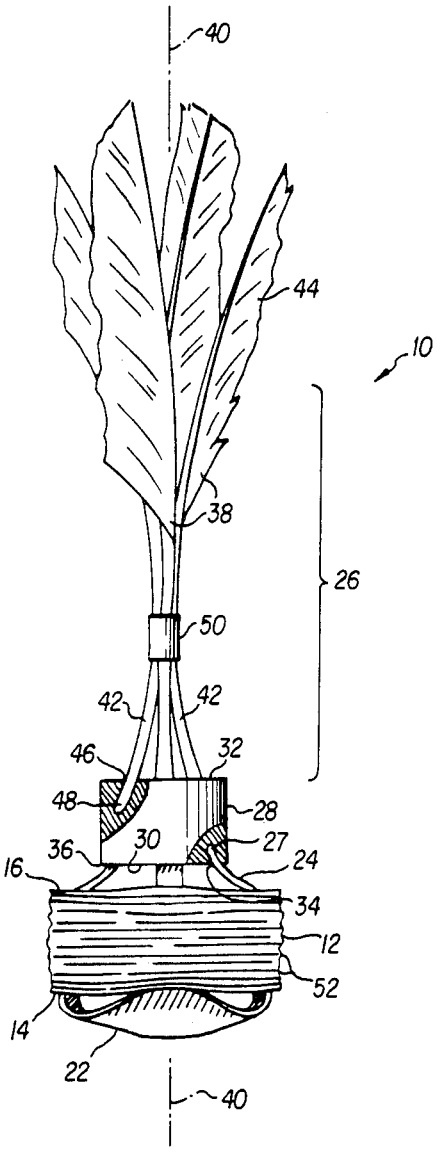
FIG. 1 is a side view of the shuttlecock according to one embodiment of the present invention.
Figure 2:
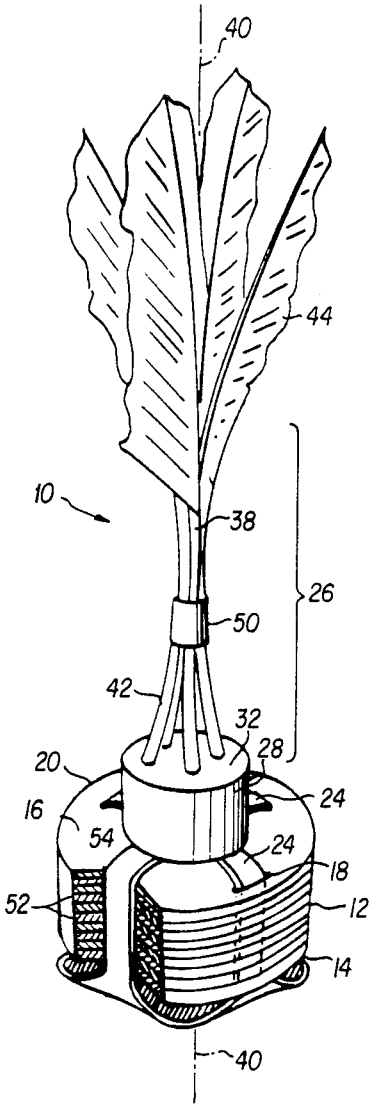
FIG. 2 is a perspective view of the shuttlecock illustrated in FIG. 1 with a portion removed as viewed from above.

FIGS. 1–2 illustrate a shuttlecock 10 according to one embodiment of the present invention. The shuttlecock 10 includes a disc shaped multi-layered weighted base 12. The base 12 has respective front and rear sides 14 and 16 and a plurality of circumferentially spaced, elongated axial slots 18 located adjacent a marginal edge 20 of the base 12. A hemispherically shaped flexible cushion 22 is attached to the base 12 by means of integral radially extending straps 24 which are threaded through the slots 18 from the front side 14 of the disc 12. The straps 24 each have a respective free end 27 which extend beyond the rear side 16 of the base 12. The straps 24 are drawn through the slots 18 causing the cushion 22 to be drawn adjacent the front side 14 of the base 12 as shown.

According to the embodiment illustrated in FIGS. 1 and 2 the shuttlecock 10 has a tail portion 26 attached to the base 12. A first collar 28 of the tail portion 26 is attached to the straps 24 adjacent to the rear side 16 of the base 12. The first collar 28 has respective front and rear sides 30 and 32. A plurality of axial slots 34, corresponding in number to the number of slots 18 in the base 12, are formed in the front side 30 of the first collar 28. Free ends 27 of the straps 24 are located one each in the slots 34 for attaching the first collar 28 to the cushion 22 with the base 12 secured therebetween as shown. The slots 34 are formed near an outboard edge or margin 36 of the first A plurality of tail feathers 38 are attached to the second collar 28 as shown. The tail feathers 38 are aligned generally with the central axis 40 of the shuttlecock 10. The tail feathers 38 each having a quill portion 42 located proximate the first collar 28 and a vane portion 44 remote from the first collar 28 (FIG. 1). The first collar 28 has a plurality of axial holes 46 formed in the rear side 32, one each for receiving a terminal end 48 of the quill portion 42 of a corresponding feather 38. A second collar 50 in the form of an elongated annular ring surrounds the quill portions 42 of the tail feathers 38 near vanes 44 and secures the quill portions 42 in intimate clustered relationship about the axis 40. The quill portions 42 are drawn together inboard of the axial holes 46 in the first collar 28 so that the tail feathers 38 are more or less tangentially disposed with respect to the axis 40 of the shuttlecock 10 and the vanes 44 extend away from the rear side 32 of the first collar in a smooth arc as shown.

Figure 3:
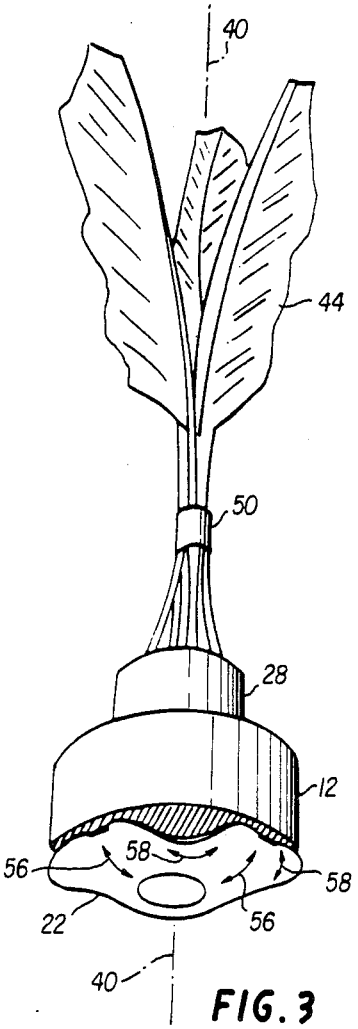
FIG. 3 is a perspective of the shuttlecock according to another embodiment of the present invention as viewed from below.

The configuration of the feathers 38 in the embodiments illustrated in FIGS. 1–3 provides significant stability to the desired trajectory of the shuttlecock 10. The second collar 50 stabilizes the position of each feather 38 with respect to the central axis 40 so that the vane portions 44 extend radially outwardly as shown. The aerodynamics of the shuttlecock 10 is enhanced because the vanes 44 are firmly positioned by the second collar 50 with respect to the axis 40 for providing a controlled and stable drag on the shuttlecock 10 as it flies through the air. In the embodiments shown, the position of the vanes 44 relative to the axis 40 is stabilized by the second collar 5 which locks the quill portions 42 of the feathers 38 together in intimate clustered relationship about the axis 40. The feathers 38 may be natural or artificial as desired.

In accordance with the present invention, the base 12 is formed of a plurality of discs 52 each of which has a plurality of elongated holes 54 therein in a configuration similar to every other disc 52 so that the discs may be aligned with the holes 54 in registration for forming the slots 18. The discs 52 are preferably made of a resilient material such as a natural or synthetic rubber, although other flexible sheet like materials may be utilized as desired. The base 12 may be a resilient solid member being fully or partially hollowed out to control the weight according to the embodiment illustrated in FIG. 3.

The cushion 22 is likewise formed of a resilient sheet material such as natural or synthetic rubber in order to provide the necessary resiliency and proper softness for prolonged use without injuring the user.

Figure 4:
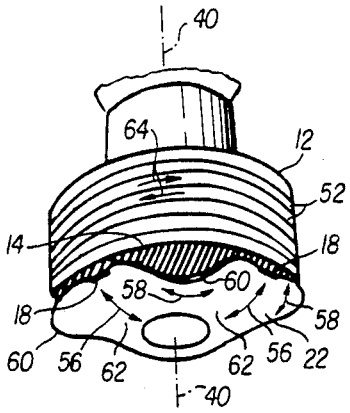
FIG. 4 is a perspective view of the weighted base as viewed from below illustrating the various modes of deformation of the base.

In accordance with the invention the base 12 has a number of degrees of flexibility in order to provide a cushion for the hand of the user. In FIG. 4 the base 12 is shown in perspective from below in order to feature the interaction of the cushion 22 and the discs 52. The particular hemispherical shape of the cushion 22 is such that it allows radial and circumferential flexibility, illustrated by the arrows 56 and 58 respectively. Marginal portions of the cushion 22 intermediate slots 18 form arcuate sections 60 spaced from the front side 14 of the base 12 which allow the cushion 22 to stretch and deform along the circumferential direction as illustrated by the arrows 58. Radial portions 62 of the cushion 22 extend between the central axis 40 and the slots 18 and provide flexbility for the cushion 22 in the radial direction illustrated by the arrows 56. Thus, there is a significant degree of resiliency in the cushion 22 when struck from below or the side which may be utilized by the player without injury to the player's hand or other body parts.

Figure 5:
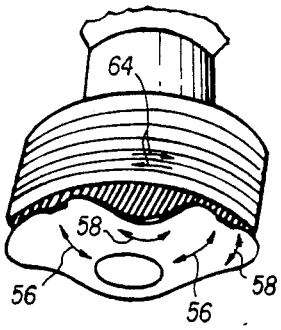
FIG. 5 is a perspective view of the weighted base shown in FIG. 4 illustrating lateral deformation of the base.

The base 12 also has lateral resiliency illustrated by the arrows 64. When the base 12 is struck from the side, the discs 52 slide relative to each other so that the base 12 deforms as shown in FIG. 5 and absorbs the impact. In the arrangement shown in FIG. 3, the base 12 is solid but resilient. The base in FIG. 3 can deform laterally.

Figure 6:
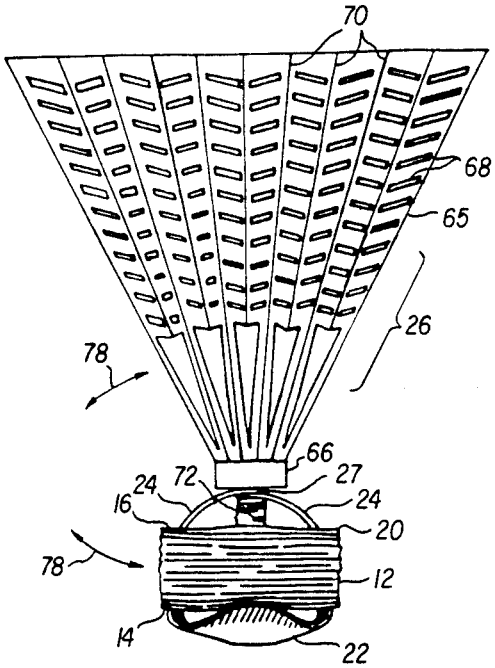
FIG. 6 is a side elevation of the shuttlecock according to another embodiment of the invention illustrating the attachment of the base to the tail portion.
Figure 8:
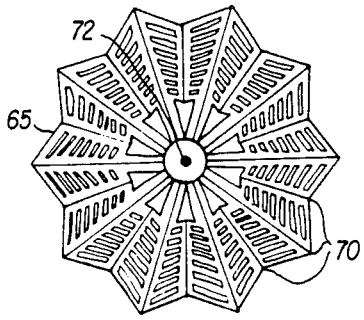
FIG. 8 is a top view of the tail portion of the shuttlecock according to the embodiment of the invention shown in FIG. 6.

In another embodiment of the invention illustrated in FIG. 6, the tail 26 is formed of an apertured cone 65 flaring away from the collar 66. The cone 65 is formed with apertures 68 which modify the drag of the tail 26. The cone 65 may also have zig zag folds 70 (FIG. 8), the purpose of which is to allow the tail 26 to be of a given surface area for it to create length and width shown. The number and size of the aperture 68 and the surface area of the tail 26 as well as the shape of the cone 65 can be modified to tailor the aerodynamic drag.

Figure 7:
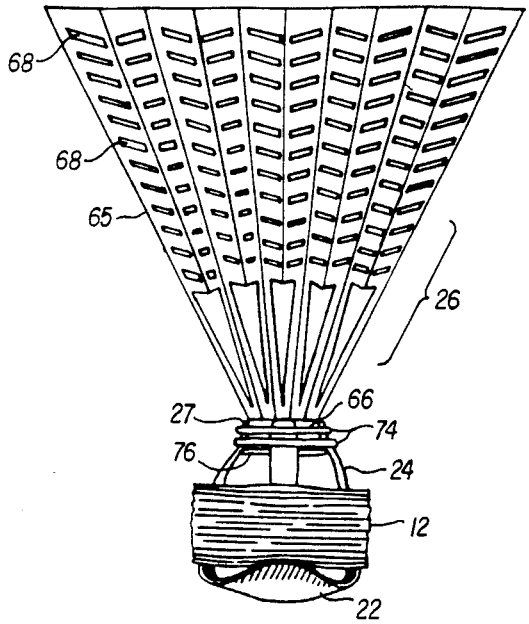
FIG. 7 is a side elevation of the shuttlecock according to another embodiment of the invention.

In the embodiment shown in FIG. 6, the base 22 is attached to the collar 66 by a nail or rivet 72. The ends 27 of the straps 24 are overlapped, as shown, and the rivet or nail 72 secures the straps 24 to the collar 66. However, the straps 24 may be secured to the tail by other suitible means, such as, for example, hot glue or other adhesive. In FIG. 7, the straps 24 are secured to the collar 66 by bands 74, which surround the free ends 27 of the straps 24. The collar 66 has a lower beaded edge 76 to capture the bands 74 in place.

In all the arrangements illustrated (FIGS. 1–3, 7 and 8) the base 12 is flexibly attached to the tail 26. Thus, the base 26 may pivot relative to the tail 26 because the straps 24 attaching the tail 26 to the base 12 are flexible. This pivotal flexibility provides an additional degree of freedom to the device which is illustrated by the opposed curved arrows 78 in FIG. 6.

The invention is not restricted solely to use in a particular game. The shuttlecock can be used in any game where such a device can be struck back and forth between two or more players. The shuttlecock according to the present invention has been designed especially for use in games where the hands, feet and other body parts are utilized for striking shuttlecocks.

While the invention has been described in connection with the specific embodiment thereof, it will be understood that it is capable of further modifications. The claims are intended to cover any variations, uses or adaptations of the invention following, in general, the principles of the invention, and including such departures from the present disclosures, within known and customary practice within the art to which the invention pertains.

What is claimed is:

1. A shuttlecock having a central axis comprising:

a weighted base, said base having front and rear sides and a plurality of circumferentially spaced axial holes positioned adjacent to an outer margin of the base;

a cushion formed of a flexible sheet material in the form of a circular member and a plurality of radial straps corresponding in number to the number of holes in the base, said radial straps extending from an outer margin of the circular member, each of said straps having a free end, one each being fed through a corresponding one of the holes, such that, the cushion is drawn adjacent to the front side of the base, said circular member forming a curved surface over the front side of the base, portions of said curved surface between adjacent straps being arcuately spaced away from the front surface and having circumferential flexibility, and portions of said curved surface extending between the central axis and a hole being arcuately spaced away from the front surface of the base and having radial flexibility;

a tail for providing drag being flexibly attached to the free ends of the straps to provide pivotal flexibility between the base and the tail.

2. A shuttlecock according to claim 1 wherein said tail is comprised of a plurality of feathers, each having a quill portion proximate the tail and a vane portion remote therefrom.

3. A shuttlecock according to claim 2 wherein said tail is comprised of a first collar having respective front and rear sides being attached to free ends of the straps, such that, the front side of the first collar is in confronting relationship with the rear side of the base, said first collar and cushion being attached for securing the base therebetween, said first collar having a plurality of circumferentially spaced axial holes in the front side for receiving therein respective ones of the free ends of the straps, the first collar having a plurality of openings in the rear side for receiving the quill portion of one each of the feathers therein;

a second collar located in spaced relation with the first collar, said second collar surrounding the quill portion of the feathers for drawing the said quill portions together in clustered intimate relationship about the central axis of the shuttlecock for stabilizing the position of the feathers with respect to the central axis and said vane portions extending arcuately and radially away from the base portion in a stabilized position relative thereto.

4. A shuttlecock according to claim 1 where said cushion is comprises:

a hemispherically shaped resilient sheet material formed with a plurality of symmetrically spaced straps corresponding in number to the number of holes in said base.

5. A shuttlecock according to claim 1 where said base includes a plurality of apertured discs being attached to the tail by means of the straps of the cushion, and the discs being slidable laterally.

6. A shuttlecock according to claim 1 wherein said holes in said base have a rectangular cross-section and conform in shape and size to the shape of said straps such that said straps slide through said holes.

7. A shuttlecock according to claim 1 wherein said tail comprises an apertured cone.

8. A shuttlecock according to claim 7 wherein the cone is formed with a fan fold zig-zag shape.

9. A shuttlecock according to claim 7 wherein the free ends of the straps are overlapped and attached to said tail.

10. A shuttlecock according to claim 9 wherein the free end of each strap has a hole formed therein and a rivet secured to the tail passes through said holes to pivotally secure the base to the tail.

* * * * *